US008465133B2

(12) United States Patent
Park et al.

(10) Patent No.: US 8,465,133 B2
(45) Date of Patent: Jun. 18, 2013

(54) INK PUMP WITH FLUID AND PARTICULATE RETURN FLOW PATH

(75) Inventors: Daniel Clark Park, West Linn, OR (US); Michael E. Jones, West Linn, OR (US)

(73) Assignee: Xerox Corporation, Norwalk, CT (US)

( * ) Notice: Subject to any disclaimer, the term of this patent is extended or adjusted under 35 U.S.C. 154(b) by 353 days.

(21) Appl. No.: 12/890,998

(22) Filed: Sep. 27, 2010

(65) Prior Publication Data

US 2012/0075390 A1 Mar. 29, 2012

(51) Int. Cl.

| | |
|---|---|
| ***B41J 2/175*** | (2006.01) |
| ***F04C 29/02*** | (2006.01) |
| ***F04B 39/02*** | (2006.01) |

(52) U.S. Cl.
USPC ..... 347/85; 418/102; 417/366

(58) Field of Classification Search
USPC ..... 418/102
See application file for complete search history.

(56) References Cited

U.S. PATENT DOCUMENTS

| | | | | |
|---|---|---|---|---|
| 4,320,407 | A | 3/1982 | Goldis et al. | |
| 4,336,037 | A | 6/1982 | Goldis et al. | |
| 4,518,331 | A | 5/1985 | Wood | |
| 4,792,292 | A * | 12/1988 | Gaenzle | 417/440 |
| 5,466,131 | A | 11/1995 | Altham et al. | |
| 5,540,569 | A | 7/1996 | Altham et al. | |
| 5,708,313 | A | 1/1998 | Bowes et al. | |
| 6,241,486 | B1 | 6/2001 | Sloteman | |
| 6,280,157 | B1 | 8/2001 | Cooper | |
| 6,523,944 | B1 | 2/2003 | Roy et al. | |
| 6,558,127 | B2 | 5/2003 | Maruyama et al. | |
| 7,131,555 | B2 | 11/2006 | Maruyama et al. | |
| 7,267,532 | B2 | 9/2007 | Krebs | |
| 7,290,923 | B2 | 11/2007 | Fischer et al. | |
| 7,401,889 | B2 | 7/2008 | Iwasaki | |
| 7,470,447 | B2 | 12/2008 | Maruyama et al. | |
| 7,520,967 | B2 | 4/2009 | Maruyama et al. | |
| 2003/0059329 | A1 * | 3/2003 | Oehman et al. | 418/102 |
| 2006/0057003 | A1 | 3/2006 | Mitsuda et al. | |
| 2007/0024681 | A1 * | 2/2007 | Umeda | 347/84 |
| 2010/0026739 | A1 * | 2/2010 | Hirashima | 347/85 |

FOREIGN PATENT DOCUMENTS

JP 11210646 A * 8/1999

* cited by examiner

*Primary Examiner* — Shelby Fidler
(74) *Attorney, Agent, or Firm* — Maginot, Moore & Beck, LLP

(57) ABSTRACT

A bidirectional sealless ink pumping system used in an inkjet printing device includes a liquid ink reservoir and a pump. The pump moves ink from the reservoir through a pumping chamber to supply ink to printheads in the printer, and moves ink from a recirculation receptacle through the pumping chamber to the reservoir. A portion of the ink in the pumping chamber is drawn out of the pumping chamber to lubricate the moving member and is filtered before returning to the pumping chamber.

20 Claims, 5 Drawing Sheets

INK PUMP WITH FLUID AND PARTICULATE RETURN FLOW PATH

TECHNICAL FIELD

This disclosure relates generally to machines that pump fluid to and from a reservoir, and more particularly, to a system for pumping liquid ink to and from an ink reservoir.

BACKGROUND

Fluid transport systems are well known and used in a number of applications. One specific application of transporting a fluid in a machine is the transportation of ink in a printer. Common examples of inks include aqueous inks and phase change or solid inks. Aqueous inks remain in a liquid form when stored prior to being used in imaging operations. Solid ink or phase change inks typically have a solid form, either as pellets or as sticks colored cyan, yellow, magenta and black. The solid ink is inserted into a printer and delivered to a melter, which melts the solid ink. The melted ink is collected in a reservoir where the melted ink continues to be heated to maintain its fluid form while awaiting subsequent use.

One or more printheads may be operatively connected to a reservoir to receive a flow of melted ink. The melted ink is ejected from a printhead by inkjet ejectors within the printhead onto a receiving medium or imaging member. The inkjet ejectors in the inkjet printing apparatus may be piezoelectric devices that eject the ink onto an imaging surface. The inkjet ejectors are selectively activated by a controller with a driving signal.

Ink supplied from a reservoir to one or more printheads may be pumped from the reservoir using various pump configurations. One configuration of a suitable pump employs rotating gears that cause ink to flow from a reservoir towards one or more printheads. Other common configurations use reciprocating members instead of rotating members to pump the melted ink from a reservoir. These pumps employ one or more seals that isolate components of the pump from direct contact with the melted ink pumped from the reservoir. These seals are typically made of elastomeric materials. The isolated pump components may also be lubricated to reduce friction during operation.

During operation, moving surfaces of the pumping mechanism that come in contact with other components in the reservoir may experience wear. Debris eroded from the worn components may damage the pumping components, and may also contaminate ink supplied to the printhead. Wear may be accelerated if there is insufficient lubrication of moving components in the pump. Additionally, certain ink chemistries used in printers may degrade the seals used in common pump configurations, causing a loss of lubricant and formation of additional debris. An ink pumping system that improves the wear characteristics of moving components and that impedes contaminants from being supplied to printheads would be beneficial.

SUMMARY

A pumping system for moving ink in a printer has been developed. The pumping system includes a pumping chamber having an inlet and an outlet, a reservoir configured to store ink, the reservoir having an outlet fluidly connected to the inlet of the pumping chamber, a moving member having a first portion positioned in the pumping chamber to contact and move ink from the inlet of the pumping chamber to the outlet of the pumping chamber and a second portion positioned outside of the pumping chamber, a channel configured about the portion of the moving member positioned outside of the pumping chamber, the channel having a first end and a second end, the first end of the channel being directly connected to the pumping chamber and the second end of the channel being directly connected to the reservoir to enable a portion of the ink in the pumping chamber to move from the pumping chamber and lubricate the portion of the moving member outside of the pumping chamber and return to the reservoir.

An ink pumping system has been developed. The ink pumping system includes an ink reservoir configured to store liquid ink, the reservoir including an outlet, a pumping chamber having an inlet and an outlet, the inlet of the pumping chamber being fluidly coupled to the outlet of the reservoir, a moving member disposed in the pumping chamber, the moving member being configured to move ink through the pumping chamber, a bearing having a first end operatively connected to the pumping chamber and a second end that terminates at a position above a floor of the ink reservoir, the bearing forming a channel between the pumping chamber and the second end of the bearing, and a drive shaft positioned in the channel of the bearing. The drive shaft is operatively connected to the moving member to move the moving member in the pumping chamber to move ink through the pumping chamber and to urge a portion of the ink in the pumping chamber into and through a space in the channel formed between the drive shaft and the bearing.

A sealless ink pumping system has been developed. The sealless ink pumping system includes an ink reservoir configured to store liquid ink, the reservoir includes an outlet, a pumping chamber having an inlet and an outlet, the inlet of the pumping chamber is fluidly coupled to the outlet of the reservoir, a moving member disposed in the pumping chamber, a sealless bearing having a first opening in fluid communication with the pumping chamber and a second opening at a position above a floor of the ink reservoir, the sealless bearing forms a channel between the pumping chamber and the second opening of the sealless bearing, and a drive shaft positioned in the channel of the sealless bearing. The moving member is configured to move ink through the pumping chamber. The drive shaft is operatively connected to the moving member to move the moving member in the pumping chamber to displace ink from the pumping chamber and urge a portion of the ink in the pumping chamber through the channel in the sealless bearing.

DETAILED DESCRIPTION

Figure 1:
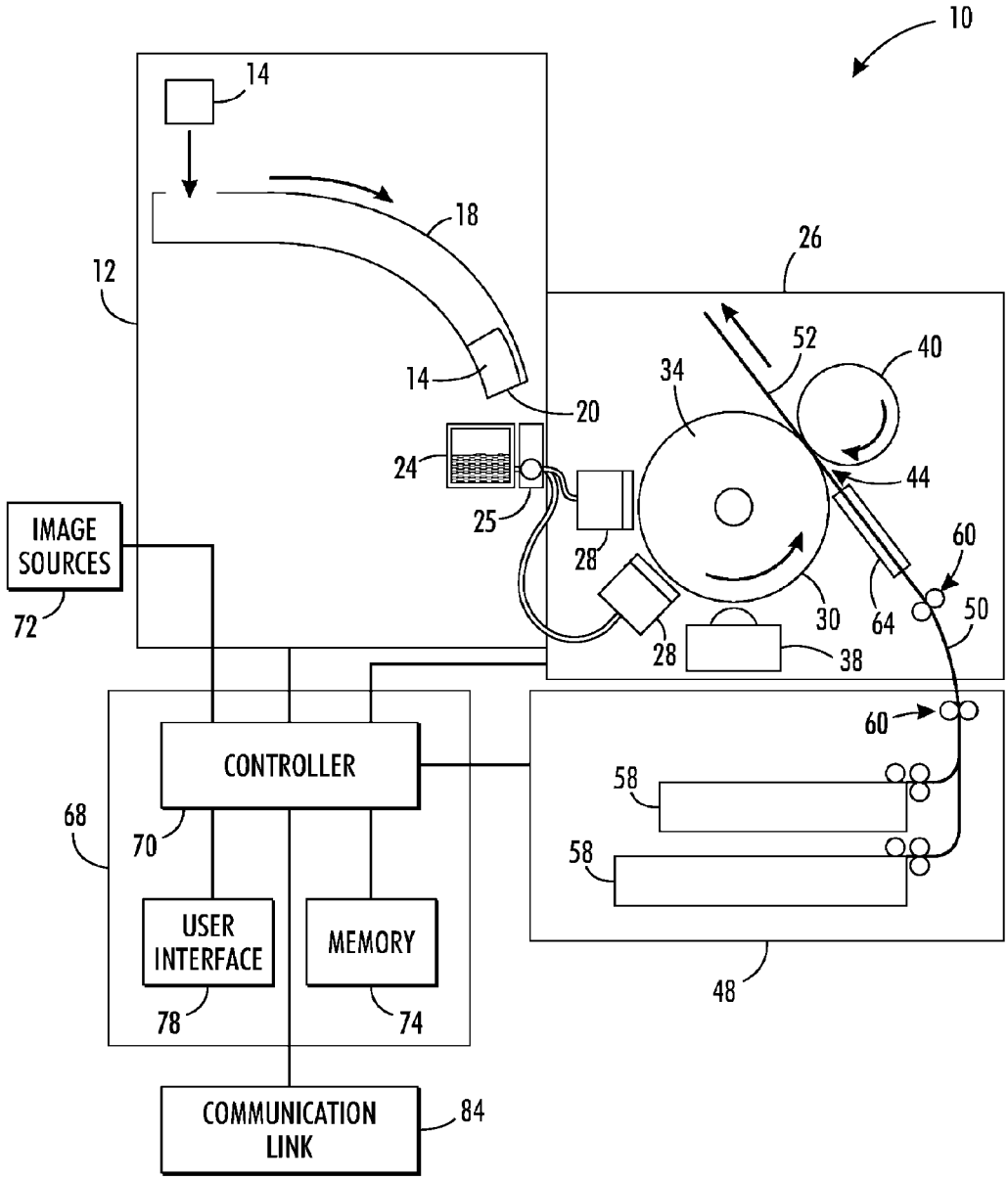
FIG. 1 is a schematic view of an embodiment of a phase change ink imaging device having an intermediate printing member and a control system.

The description below and the accompanying figures provide a general understanding of the environment for the system and method disclosed herein as well as the details for the system and method. In the drawings, like reference numerals are used throughout to designate like elements. As used herein, the term "pumping chamber" refers to a volume within an enclosure in which the enclosure contains a least a portion of a moving member that displaces a fluid to enable the fluid to flow from one opening of the pumping chamber to another opening of the pumping chamber.

FIG. 1 is a side schematic view of an embodiment of a phase change ink imaging device configured for indirect or offset printing using melted phase change ink. The device 10 of FIG. 1 includes an ink handling system 12, also referred to as an ink loader, which is configured to receive phase change ink in solid form, such as blocks of ink 14, which are commonly called ink sticks. The ink loader 12 includes feed channels 18 into which ink sticks 14 are inserted. Although a single feed channel 18 is visible in FIG. 1, the ink loader 12 includes a separate feed channel for each color or shade of color of ink stick 14 used in the device 10. The feed channel 18 guides ink sticks 14 toward a melting assembly 20 at one end of the channel 18 where the sticks are heated to a phase change ink melting temperature to melt the solid ink to form liquid ink. Any suitable melting temperature may be used depending on the phase change ink formulation. In one embodiment, the phase change ink melting temperature is approximately 100° C. to 140° C. The melted ink is received in a reservoir 24 configured to maintain a quantity of the melted ink in molten form for delivery to printing system 26 of the device 10. A pump 25 is fluidly connected to reservoir 24 and printheads 28 to move melted ink from reservoir 24 to one or more printheads 28. Suitable embodiments of pump 25 include, but are not limited to, gear pumps, reciprocating pumps, or the like.

The printing system 26 includes at least one printhead 28 having inkjets arranged to eject drops of melted ink onto an intermediate surface 30. Two printheads are shown in FIG. 1 although any suitable number of printheads 28 may be used. The intermediate surface 30 comprises a layer or film of release agent applied to a rotating member 34 by the release agent application assembly 38, which is also known as a drum maintenance unit (DMU). The rotating member 34 is shown as a drum in FIG. 1 although in alternative embodiments the rotating member 34 may comprise a moving or rotating belt, band, roller or other similar type of structure. A nip roller 40 is loaded against the intermediate surface 30 on rotating member 34 to form a nip 44 through which sheets of recording media 52 are fed in timed registration with the ink drops deposited onto the intermediate surface 30 by the inkjets of the printhead 28. Pressure (and in some cases heat) is generated in the nip 44 that, in conjunction with the release agent that forms the intermediate surface 30, facilitates the transfer of the ink drops from the surface 30 to the recording media 52 while substantially preventing the ink from adhering to the rotating member 34.

The imaging device 10 includes a media supply and handling system 48 that is configured to transport recording media along a media path 50 defined in the device 10 that guides media through the nip 44, where the ink is transferred from the intermediate surface 30 to the recording media 52. The media supply and handling system 48 includes at least one media source 58, such as supply tray 58 for storing and supplying recording media of different types and sizes for the device 10. The media supply and handling system includes suitable mechanisms, such as rollers 60, which may be driven or idle rollers, as well as baffles, deflectors, and the like, for transporting media along the media path 50.

The media path 50 may include one or more media conditioning devices for controlling and regulating the temperature of the recording media so that the media arrives at the nip 44 at a suitable temperature to receive the ink from the intermediate surface 30. For example, in the embodiment of FIG. 1, a preheating assembly 64 is provided along the media path 50 for bringing the recording media to an initial predetermined temperature prior to reaching the nip 44. The preheating assembly 64 may rely on contact, radiant, conductive, or convective heat to bring the media to a target preheat temperature, which in one practical embodiment, is in a range of about 30° C. to about 70° C. In alternative embodiments, other thermal conditioning devices may be used along the media path before, during, and after ink has been deposited onto the media for controlling media (and ink) temperatures.

A control system 68 aids in operation and control of the various subsystems, components, and functions of the imaging device 10. The control system 68 is operatively connected to one or more image sources 72, such as a scanner system or a work station connection, to receive and manage image data from the sources and to generate control signals that are delivered to the components and subsystems of the printer. Some of the control signals are based on the image data and these signals cause the components and subsystems of the printer to perform various procedures and operations for producing images on media with the imaging device 10.

The control system 68 includes a controller 70, electronic storage or memory 74, and a user interface (UI) 78. The controller 70 comprises a processing device, such as a central processing unit (CPU), an application specific integrated circuit (ASIC), a field programmable gate array (FPGA) device, or a microcontroller. Among other tasks, the processing device processes images provided by the image sources 72. The one or more processing devices comprising the controller 70 are configured with programmed instructions that are stored in the memory 74. The controller 70 executes these instructions to operate the components and subsystems of the printer. Any suitable type of memory or electronic storage may be used. For example, the memory 74 may be a non-volatile memory, such as read only memory (ROM), or a programmable non-volatile memory, such as EEPROM or flash memory.

User interface (UI) 78 comprises a suitable input/output device located on the imaging device 10 that enables operator interaction with the control system 68. For example, UI 78 may include a keypad and display (not shown). The controller 70 is operatively coupled to the user interface 78 to receive signals indicative of selections and other information input to the user interface 78 by a user or operator of the device. Controller 70 is operatively coupled to the user interface 78 to display information to a user or operator including selectable options, machine status, consumable status, and the like. The controller 70 may also be coupled to a communication link 84, such as a computer network, for receiving image data and user interaction data from remote locations.

The controller 70 generates control signals that are output to various systems and components of the device 10, such as the ink handling system 12, printing system 26, media handing system 48, release agent application assembly 38, media path 50, and other devices and mechanisms of the imaging device 10 that are operatively connected to the controller 70. Controller 70 generates the control signals in accordance with programmed instructions and data stored in memory 74. The control signals, for example, control the operating speeds, power levels, timing, actuation, and other parameters, of the system components to cause the imaging device 10 to operate in various states, modes, or levels of operation, that are denoted in this document collectively as operating modes. These operating modes include, for example, a startup or warm up mode, shutdown mode, various print modes, maintenance modes, and power saving modes.

Figure 2:
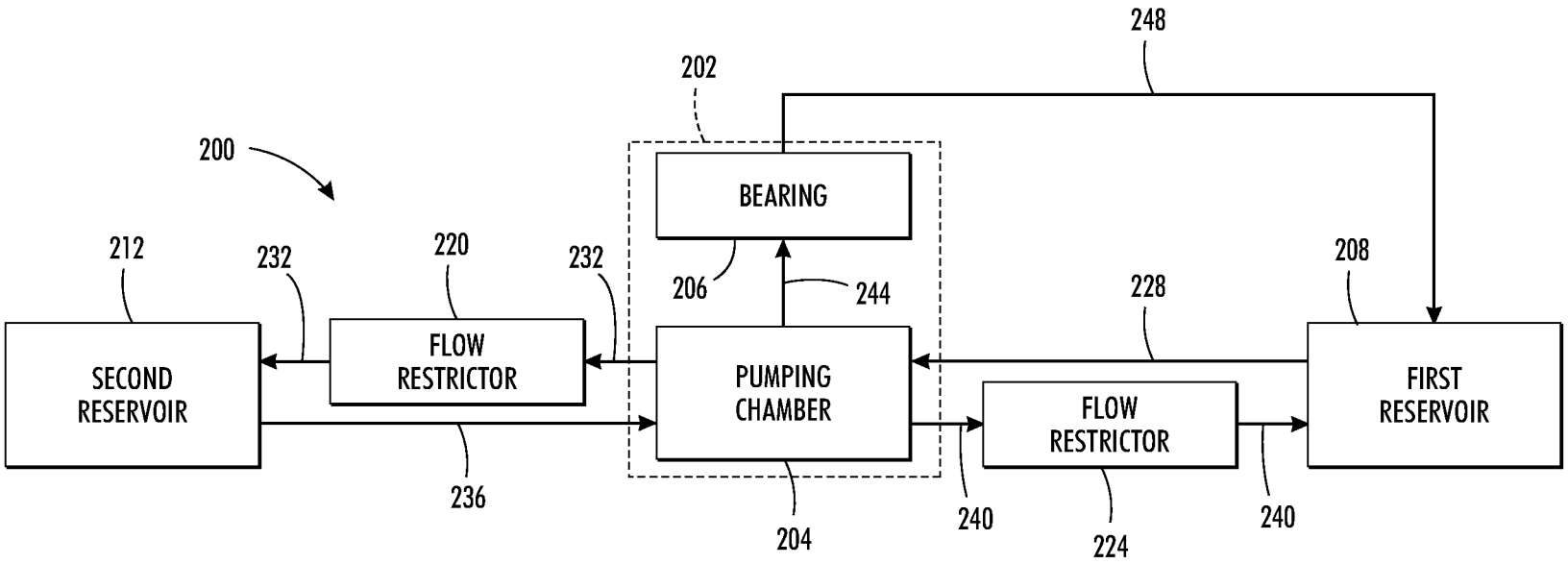
FIG. 2 is a schematic diagram of an ink pumping system with a reversible pump that has a fluid return path to an ink reservoir.

FIG. 2 depicts a block diagram of an ink delivery system 200 that includes a pump 202 configured to transfer ink between a first ink reservoir 208 and a second reservoir 212. Pump 202 includes a bearing 206 and a pumping chamber 204 that fluidly communicates with a first ink reservoir 208 and second ink reservoir 212. The pumping chamber 204 has an opening that is in fluid communication with the bearing 206. In operation, pressure generated in pumping chamber 204 urges a portion of ink pumped through the pumping chamber in direction 244 through bearing 206. Ink flows around bearing 206 to lubricate moving parts of the pump in the bearing, such as a pump shaft or the like, and then the ink exits the bearing and returns to the first ink reservoir 208 as shown by arrow 248.

The pump 202 in ink delivery system 200 may be operated to move ink from the first reservoir 208 to the second reservoir 212 in a forward mode of operation, and to move ink from the second reservoir 212 to the first reservoir 208 in a reverse mode of operation. A flow restrictor 220 resists the flow of fluid between the pump 202 and the second reservoir 212 when moving ink in the forward operating mode, and another flow restrictor 224 resists the flow of fluid between the pump 202 and the first reservoir when moving ink in the reverse operating mode. Various embodiments of flow restrictors include one-way check valves, ink conduits with varying widths and shapes, porous membranes that resist a flow of ink, or any mechanism or fluid path arrangement that provides a resistance to fluid flow. As seen in more detail below, various flow restrictor embodiments may be integrated with a pump, such as pump 202, or may be located in other components, such as ink reservoirs that are in fluid communication with the pump. Each flow restrictor resists ink flow out of pumping chamber 204. Thus, pressure generated in pumping chamber 204 urges ink into the bearing 206 when the pump 202 moves ink in either of the forward or reverse operating modes.

In a forward mode of operation, pump 202 withdraws ink from the first reservoir 208 in direction 228. Pump 202 moves ink through flow restrictor 220 in direction 232 and into the second reservoir 212. Pressure generated in pumping chamber 204 urges a portion of the ink through the bearing 206 in direction 244. Flow restrictor 220 establishes a pressure within pumping chamber 244 that enables ink to flow into bearing 206 and to return to the first reservoir 208. In the reverse mode of operation, pump 202 withdraws ink from the second reservoir 212 in direction 236. In the second mode of operation, pump 202 moves ink in direction 240 through flow restrictor 224 into the first reservoir 208. As with the forward operating mode, flow restrictor 224 establishes a pressure within pumping chamber 244 that enables ink to flow into bearing 206 and to return to the first reservoir 208. Thus, in both the forward and reverse modes of operation, pressure established within pumping chamber 204 urges ink into the bearing 206 to lubricate moving parts of the pump 202 as the ink returns to the first reservoir 208.

Figure 3:
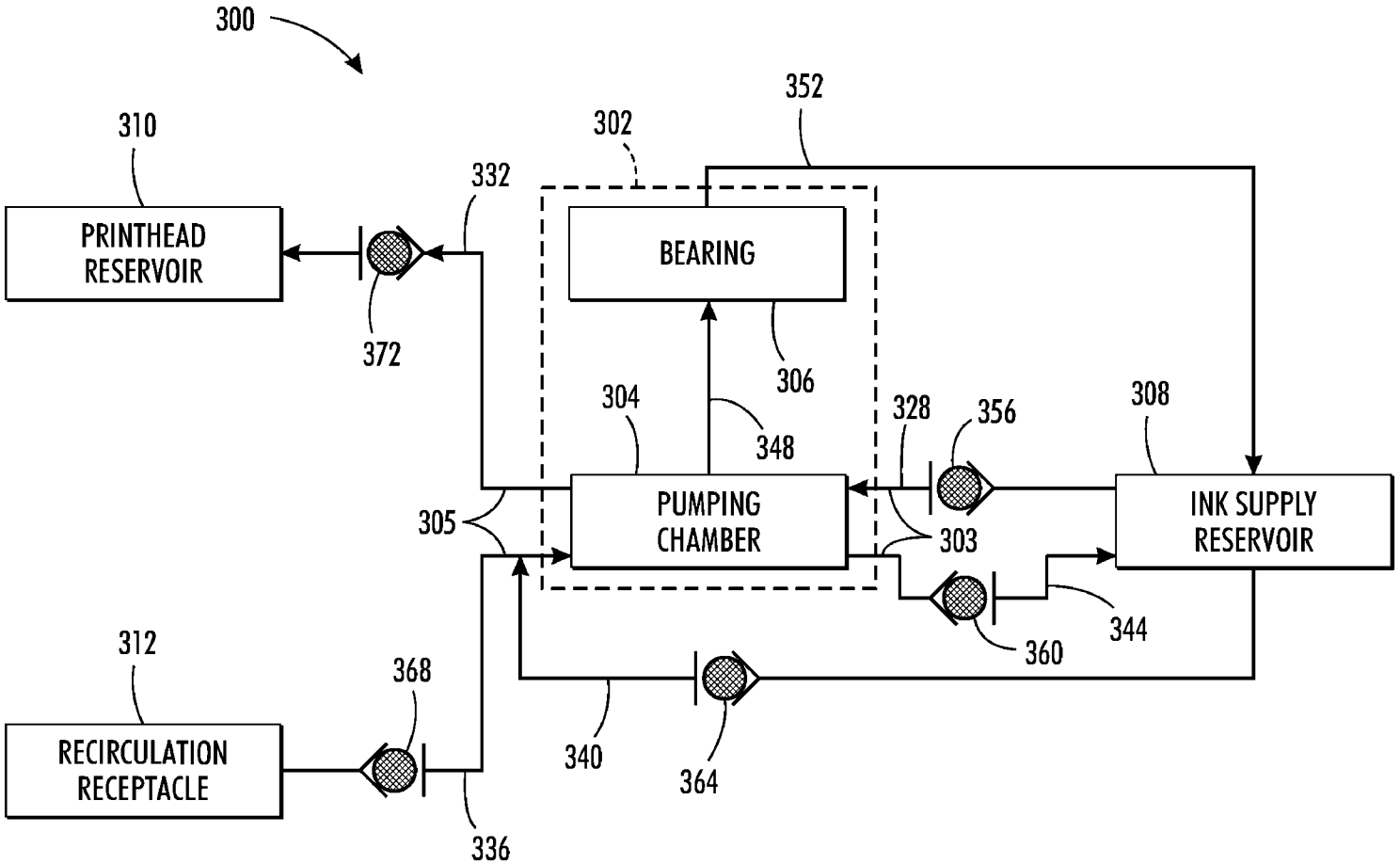
FIG. 3 is a schematic diagram of another ink pumping system with a reversible pump that has a fluid return path to an ink reservoir.

FIG. 3 depicts a schematic view of an alternative embodiment of an ink delivery system 300 including a pump 302 configured to transfer ink between an ink supply reservoir 308, a printhead reservoir 310, and a recirculation receptacle 312. Similar to pump 202 described above, pump 302 includes a pumping chamber 304 that fluidly communicates with a bearing 306. One-way valves 356, 360, 364, 368, and 372 place pumping chamber 304 in selective fluid communication with ink supply reservoir 308, printhead reservoir 310, and recirculation receptacle 312. Pumping chamber 304 includes at least one inlet opening 303 and at least one outlet opening 305. In a forward mode of operation, ink enters the pumping chamber 304 through inlet 303 and exits through outlet 305, while in a reverse mode of operation ink enters the pumping chamber 304 through outlet 305 and exits via inlet 303. In operation, pressure generated in pumping chamber 304 urges a portion of ink moved through the pumping chamber in direction 348 through bearing 306. Ink flows around bearing 306, lubricating moving parts of the pump in the bearing such as a pump shaft or the like, and then exits the bearing to return to the first ink reservoir 308 as shown by arrow 352.

Pump 302 operates in forward and reverse modes. In a forward operating mode, pump 302 is in fluid communication with the ink supply reservoir 308 through opened one-way valve 356 and with printhead reservoir 310 through opened one-way valve 327. In the forward operating mode, one-way valves 356 and 372 open in response to pressure generated by pump 302, and one-way valves 360, 364, and 368 remain closed. Pump 302 withdraws ink from ink supply reservoir 308 through one-way valve 356 in direction 328 and moves the ink through one-way valve 372 in direction 332 and into printhead reservoir 310. Ink in printhead reservoir 310 is available for use in inkjet printing operations as described above with reference to FIG. 1. In the example embodiment of FIG. 3, one-way valve 356 is configured to open in response to a nominal pressure exerted by pump 302 in the forward operating mode, while one-way valve 372 is configured to establish a predetermined resistance to ink flowing from pump 302. Thus, pressure generated in pumping chamber 304 urges a portion of the ink in the pumping chamber into bearing 306 in direction 348 to lubricate moving parts pump 302 in bearing 306 and returns to ink supply 308 in direction 352. While FIG. 3 depicts one-way valve 372 as a ball valve, any flow restrictor may establish the pressure in pumping chamber 302 that allows ink to flow into bearing 306. A pressurized printhead may act as a flow restrictor, with an example of one such pressurized printhead described in further detail in co-pending application Ser. No. 12/908,165, entitled "METHOD AND SYSTEM FOR INK DELIVERY AND PURGED INK RECOVERY IN AN INKJET PRINTER," which was filed on Oct. 20, 2010, and has a common assignee to the present application.

Pump 302 is also configured to operate in a reverse mode that withdraws ink from a recirculation receptacle 312 and moves the ink to the ink supply reservoir 308. In a drop-on-demand inkjet printing device, recirculation receptacle 312 may collect ink that is purged from printhead reservoir 310 or the recirculation receptacle 312 may recover ink that is not directed onto an image receiver in a continuous stream in a continuous stream inkjet printing device. A drop-on-demand device ejects individual ink droplets in response to firing signals to form an image on an image receiver, while a continuous stream device emits a stream of ink drops that are selectively deflected to form an image on the image receiver. In the reverse operating mode, one-way valves 360, 364, and 368 open in response to pressure generated by pump 302, while one-way valves 356 and 372 remain closed. The resulting fluid paths place pump 302 in fluid communication with the recirculation receptacle 312 and ink supply reservoir 308. Pump 302 withdraws ink from recirculation receptacle 312 in direction 336. The ink exits pumping chamber 304 through one-way valve 360 in direction 344 and returns to ink supply reservoir 308. A flow bypass path 340 circulates ink from ink supply reservoir 308 through one-way valve 364 and enables the ink to enter the pumping chamber 304 through the same entry as ink from the recirculation receptacle 312.

In FIG. 3, one-way valve 360 acts as a flow restrictor. One-way valve 360 has a predetermined resistance to ink flow that restricts the flow of ink from the outlet of pumping chamber 304 to ink supply reservoir 308. The flow bypass path 340 allows additional ink to flow from the ink supply reservoir 308 into the pumping chamber 304, reducing the effective resistance to flow for ink entering the pumping chamber. In embodiments that produce a relatively high flow resistance when pumping ink from recirculation receptacle 312 to the ink supply reservoir 308, the bypass path 340 reduces the effective flow resistance occurring at the outlet 305 of pumping chamber 304 to allow a larger difference in pressure between the outlet and inlet of pumping chamber 304. The increased flow resistance from one-way valve 360 and decreased flow resistance from bypass path 340 establish a positive pressure in the pumping chamber 304 that urges ink into the bearing 306. In one example embodiment, the ambient pressure $P_0$ in bearing 306 and the ink supply reservoir 308 is approximately 14.7 psi, or one atmosphere of pressure. One-way valve 360 establishes a flow resistance that results in a pressure rise of 1.0 psi above the ambient pressure $P_0$ at the inlet 303 of pumping chamber 304. In the absence of bypass path 340, one-way valve 368 establishes a flow resistance that results in a pressure drop of 1.0 psi below the ambient pressure $P_0$ at the outlet 305 of pumping chamber 304. The flow bypass path 340 effectively reduces the flow resistance at the outlet 305 of pumping chamber 304, with an exemplary bypass path reducing the resistance to flow such that the resulting pressure drop is 0.5 psi below the ambient pressure $P_0$. The following equations provide $P_{avg}$, the average pressure in pumping chamber 304 with $P_{avg}$ calculated using specific values from the foregoing example:

$$P_{avg} = \frac{P_{inlet} + P_{outlet}}{2}$$

$$P_{avg} = \frac{(P_0 + 1.0\ psi) + (P_0 - 0.5\ psi)}{2} = P_0 + 0.25\ psi$$

Thus, the average pressure $P_{avg}$ in pumping chamber 304 is greater than the ambient pressure, which urges ink in the pressure chamber into bearing 306 for lubrication of the bearing before the ink returns to ink supply reservoir 308.

Various alternative configurations and modifications to the embodiment of FIG. 3 are envisioned. For example, a flow bypass arrangement similar to the one used in FIG. 3 for the reverse operating mode may also be used in the forward operating mode as well. Simplified embodiments may use a flow bypass path, such as bypass path 344, or a one-way valve, such as one-way valve 360. Various different flow restrictor devices may be adapted for use with the system of FIG. 3.

Figure 4:
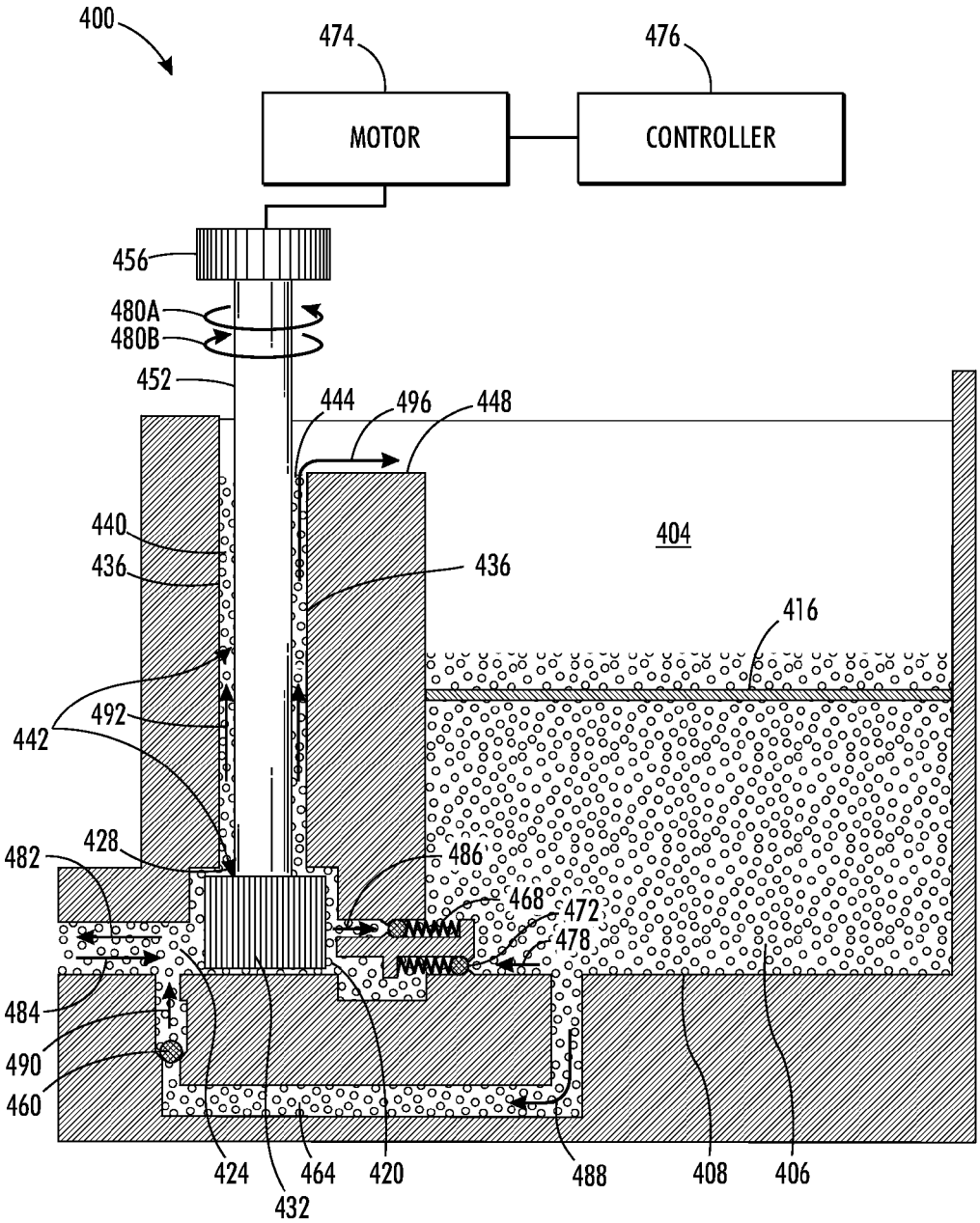
FIG. 4 is a schematic view of an ink reservoir fluidly connected to an ink pump.

FIG. 4 depicts an exemplary ink supply 400 that includes a gear pump 442 and a flow restrictor 468 that are suitable for use with an imaging device, such as device 10. Ink supply 400 includes an ink reservoir 404 holding a supply of ink 406. An ink filter 416 covers the entire width and depth of reservoir 404. Flow restrictor 468 is embodied in FIG. 4 as a one-way valve. Flow restrictor 468 and one-way valve 472, seen here as spring-biased check valves, fluidly couple reservoir 404 to a pumping chamber 420. The reservoir outlet fluidly connects to the pumping chamber through one-way valve 472 in a forward operating mode, and through one-way valve 468 in a reverse operating mode. Pumping chamber 420 includes an outlet 424 that may be coupled to a fluid conduit (not shown). Gear pump 442 includes a portion of a moving member 432, seen here as a gear used in a gear pump, disposed in pumping chamber 420, with another portion of the moving member 452, seen here as a drive shaft, extending outside of pumping chamber 420 through an opening 428. Drive shaft 452 extends through a channel 440 formed by a bearing 436. The channel 440 is in fluid communication with the pumping chamber 420 through the opening 428, which forms one end of the bearing 436, while bearing 436 has a second end 444 placed in direct fluid communication with reservoir 404 by a spillway 448. The second end 444 of bearing 436 includes an opening positioned at a level above that of floor 408 of reservoir 404. A fluid bypass channel 464 has one opening through the floor 408 of ink reservoir 404 and another opening that is in fluid communication with pumping chamber outlet 424. A one-way valve, seen here as gravity-biased check valve 460, places the bypass channel 464 in selective fluid communication with pumping chamber outlet 424 when open.

The drive shaft 452 moves within channel 440, with the example of FIG. 4 depicting drive shaft that is rotatable in directions 480A and 480B. Channel 440 has a diameter that is greater than a diameter of drive shaft 452. A drive member, embodied here in drive gear 456, connects moving member 452 to an actuator, seen here as electric motor 474. Electric motor 474 is a bidirectional actuator that may rotate the moving member in two different directions, 480A and 480B. Electric motor 474 is operatively connected to a controller 476 that may selectively activate or deactivate motor 474. In some embodiments, controller 476 may operate motor 474 in a forward direction and in a reverse direction. The functionality of controller 476 may be included in the controller 70 of FIG. 1, or in a separate device. The clearance space between a shaft, such as shaft 452, and a bearing surface, such as bearing surface 436, forms a channel 440 that enables ink in the pumping chamber 420 to flow between bearing 436 and shaft 452 for lubrication.

Figure 5:
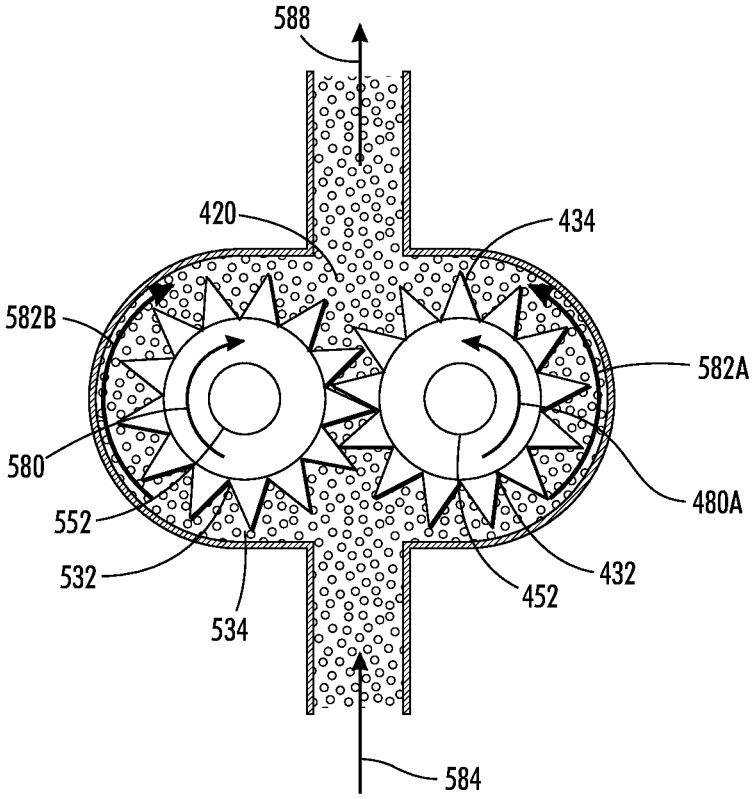
FIG. 5 is a plan view of a pumping member including two gears that is suitable for pumping ink in a printer.

In a forward operational mode, controller 476 activates motor 474, engaging drive member 456 and rotating drive shaft 452 as indicated by arrow 480A. The portion of the moving member inside pumping chamber 420 begins moving, exemplified here by rotation of gear 432. FIG. 5 shows a plan view of the pumping chamber 420 as gear 432 rotates. A second gear 532 is arranged in pumping chamber 420 with teeth 534 of gear 532 engaging teeth 434 of gear 432 and counter-rotating gear 532 in direction 580. In the example of FIG. 5, gear 534 is free to rotate about a shaft 552 in response to the rotation of gear 432. In an alternative embodiment, an actuator such as an electric motor may engage both shaft 552 and shaft 452. Ink inside of pumping chamber 420 flows around the circumference of gears 432 and 532 as shown by arrows 582A and 582B, respectively. In the configuration of FIG. 5, the rotation of gears 432 and 532 draws ink into pumping chamber 420 in direction 584 and moves the ink out of pumping chamber 420 in direction 588. The pump may move ink in the opposite direction from the depiction of FIG. 5 by reversing the rotational directions of gears 432 and 532.

Referring again to FIG. 4, in the forward mode of operation, one-way valve 472 opens in response to pressure applied by the pump, allowing ink 406 to flow into pumping chamber 420 in direction 478. One-way valves 460 and 468 remain closed in the forward mode of operation. The gear pump moves ink from the pumping chamber 420 in direction 482 through a conduit (not shown). As described above with reference to FIG. 2 and FIG. 3, a flow restrictor that is in fluid communication with the pumping chamber 420 through the conduit establishes a resistance to flow that produces a positive pressure in pumping chamber 420 in response to the pump operating in the forward mode. The positive pressure urges ink in the pumping chamber 420 in direction 492 through opening 428 into channel 440. The liquid ink surrounding drive shaft 452 and gear 432 lubricates the moving member, reducing heat and wear caused by friction on the moving member during operation. This structure accommodates and circulates fluid for lubrication, making a shaft seal unnecessary. The ink leaves channel 440 through opening 444 and flows directly into reservoir 404 over spillway 448 in direction 496.

In the reverse mode of operation, controller 476 activates motor 474, engaging drive member 456 and rotating drive shaft 452 as indicated by arrow 480B. The gear 432 shown in FIG. 4 and FIG. 5 rotates in the opposite direction of the forward operating mode, drawing ink through pumping chamber outlet 424 in direction 484. The one-way valve of flow restrictor 468 opens in response to the ink pressure, allowing ink to flow into the reservoir 404 in direction 486, and one-way valve 460 also opens, allowing ink to flow from ink reservoir 404 to the pumping chamber 420 as shown by arrows 488 and 490. In the reverse operating mode, one-way valve 472 remains closed. Flow restrictor 468 and bypass channel 464 establish a higher resistance to ink flow at the ink reservoir 404 through flow restrictor 468 than at the pumping chamber outlet 424. Bypass channel 464 supplies ink from reservoir 404 to the outlet 424 of pumping chamber 420, reducing the resistance to flow through the outlet. At the inlet, one-way valve of flow restrictor 468 provides a predetermined resistance to ink moving in direction 486. This flow resistance establishes a positive pressure in the pumping chamber 420 during the reverse operating mode, urging ink in the pumping chamber 420 into channel 440 in direction 492 to lubricate the shaft 452 and then flow into the ink reservoir in direction 496.

The ink supply 400 urges ink from pumping chamber 420 through the bearing channel 440 in both the forward and reverse operating modes. The pump 442 is a sealless pump that includes a sealless bearing 436 to enable pumping chamber 420 to urge fluid through the channel 440 without the use of a seal in bearing 436 that would isolate some or all of channel 440 from pumping chamber 420 and ink reservoir 404. As used in this document, the word "sealless" means the moving member of the pump that displaces fluid in the pumping chamber does not have structure, such as a ring or a gasket, that isolates a portion of the moving member from having contact with the fluid. Thus, ink flows in the bearing channel in direction 492 and lubricates moving parts such as shaft 452 in both the forward and reverse operating modes. In operating conditions when pumping chamber 420 contains air near the bearing opening 428, the positive pressure generated in the pumping chamber urges the air through the bearing channel 440 in direction 492. In both the forward and reverse operating modes, ink traveling through the channel 440 may carry solid contaminants eroded from the moving parts of the pump due to operational wear. Filter 416 may collect these contaminants and prevent them from entering the pumping chamber 420 through ink reservoir 404. In an exemplary embodiment, approximately one percent of the ink pumped through pumping chamber 420 flows through bearing 436 in both the forward and reverse operating modes.

The ink supply and imaging devices disclosed herein are merely exemplary embodiments of an ink supply, and various alternative components and embodiments are envisioned. Shaft 452 may be directly driven by an actuator, or may be indirectly driven via one or more gears, belts, magnetic couplings, or the like. While the moving member including gear 432 and shaft 452 are depicted as a gear pump, various pump embodiments including reciprocating pumps or other rotational pumps may be adapted to operate with the foregoing ink supply. A moving member in an alternative pump embodiment may reciprocate within the channel and pumping chamber to move ink through the pumping chamber as shown in FIG. 4. Bearing 436 may be a journal bearing having a channel with a substantially circular cross section, or may be a linear bearing having the same or an alternatively shaped cross section such as a rectangular shape. Bearing 436 may further include additional features such as a pressure dam, bushings, bearing pads, or other bearing design features known to the art. The flow restrictor depicted in FIG. 4 may include additional or fewer components. For example, if the resistance at pumping chamber outlet 424 is relatively low in an alternative embodiment, then the bypass channel 464 may be omitted. An alternative ink supply may include an additional flow restrictor integrated with the pumping chamber for use in the forward operating mode. Further, various embodiments of flow restrictors may be used instead of or in addition to the embodiments depicted in FIG. 4.

It will be appreciated that variants of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed:

1. A pumping system for moving ink in a printer comprising:

a pumping chamber having an inlet and an outlet;

a reservoir configured to store ink, the reservoir having an outlet fluidly connected to the inlet of the pumping chamber;

a moving member having a first portion positioned in the pumping chamber to contact and move ink from the inlet of the pumping chamber to the outlet of the pumping chamber and a second portion positioned outside of the pumping chamber;

a first one-way valve operatively connected between the inlet of the pumping chamber and the reservoir, the first one-way valve being configured to enable ink to flow from the reservoir through the inlet into the pumping chamber and to impede ink flow from the pumping chamber to the ink reservoir;

a second one-way valve operatively connected between the pumping chamber and the reservoir, the second one-way valve being configured to enable ink to flow from the pumping chamber into the reservoir and to impede ink flow from the ink reservoir into the pumping chamber; and a channel configured about the portion of the moving member positioned outside of the pumping chamber, the channel having a first end and a second end, the first end of the channel being directly connected to the pumping chamber and the second end of the channel being directly connected to the reservoir to enable a portion of the ink in the pumping chamber to move from the pumping chamber and lubricate the portion of the moving member outside of the pumping chamber and return to the reservoir.

2. The system of claim 1 wherein the first portion of the moving member positioned in the pumping chamber is a first gear having teeth, and the second portion of the moving member positioned outside the pumping chamber is a shaft that extends from the gear to a position that enables the shaft to be operatively connected to a motor for rotation of the shaft; and the pump further comprising:

a second gear positioned within the pumping chamber, the second gear having teeth that intermesh with the teeth on the first gear to enable the second gear to be rotated in response to the shaft being rotated by the motor.

3. The system of claim 1 further comprising:

the channel being positioned within a bearing, the bearing extending from the pumping chamber to a position within the reservoir that is above a floor of the reservoir.

4. The system of claim 1 further comprising:

a bidirectional actuator that is operatively connected to the moving member; and a controller that is operatively connected to the bidirectional actuator, the controller being configured to operate the bidirectional actuator to move the moving member and pump ink either from the inlet of the pumping chamber to the outlet of the pumping chamber or from the outlet of the pumping chamber to the inlet of the pumping chamber.

5. The system of claim 1 wherein a volume of the ink that moves through the channel is less than about five percent of a volume of ink moved by the moving member through the pumping chamber.

6. The system of claim 1 wherein the moving member is a reciprocating member that moves with respect to the pumping chamber.

7. The system of claim 1 further comprising:

a filter located in the reservoir at a position that filters ink returning to the reservoir through the channel before the ink returns to the pumping chamber.

8. A pumping system for moving ink in a printer comprising:

a pumping chamber having an inlet and an outlet;

a reservoir configured to store ink, the reservoir having an outlet fluidly connected to the inlet of the pumping chamber;

a moving member having a first portion positioned in the pumping chamber to contact and move ink from the inlet of the pumping chamber to the outlet of the pumping chamber and a second portion positioned outside of the pumping chamber;

a channel configured about the portion of the moving member positioned outside of the pumping chamber, the channel having a first end and a second end, the first end of the channel being directly connected to the pumping chamber and the second end of the channel being directly connected to the reservoir to enable a portion of the ink in the pumping chamber to move from the pumping chamber and lubricate the portion of the moving member outside of the pumping chamber and return to the reservoir;

a fluid bypass channel having a first opening that is in fluid communication with the reservoir and a second opening that is in fluid communication with the outlet of the pumping chamber; and a one-way valve positioned in the fluid bypass channel, the one-way valve being configured to enable ink to flow from the reservoir through the bypass channel to the outlet of the pumping chamber in response to ink moving from the outlet of the pumping chamber through the pumping chamber to the inlet of the pumping chamber.

9. The system of claim 8 wherein the first portion of the moving member positioned in the pumping chamber is a first gear having teeth, and the second portion of the moving member positioned outside the pumping chamber is a shaft that extends from the gear to a position that enables the shaft to be operatively connected to a motor for rotation of the shaft; and the pump further comprising:

a second gear positioned within the pumping chamber, the second gear having teeth that intermesh with the teeth on the first gear to enable the second gear to be rotated in response to the shaft being rotated by a motor.

10. The system of claim 8 wherein the channel is positioned within a bearing, and the bearing extends from the pumping chamber to a position within the reservoir that is above a floor of the reservoir.

11. The system of claim 8 further comprising:

a bidirectional actuator that is operatively connected to the moving member; and a controller that is operatively connected to the bidirectional actuator, the controller being configured to operate the bidirectional actuator to move the moving member and pump ink either from the inlet of the pumping chamber to the outlet of the pumping chamber or from the outlet of the pumping chamber to the inlet of the pumping chamber.

12. The system of claim 8 further comprising:

a flow restrictor placed in fluid communication with the outlet of the pumping chamber, the flow restrictor being configured to establish a positive pressure in the pumping chamber in response to the moving member moving ink from the inlet of the pumping chamber to the outlet of the pumping chamber.

13. The system of claim 8 wherein the moving member is a reciprocating member that moves with respect to the pumping chamber.

14. An ink pumping system comprising:

an ink reservoir configured to store liquid ink, the reservoir including an outlet;

a pumping chamber having an inlet and an outlet, the inlet of the pumping chamber being fluidly coupled to the outlet of the reservoir;

a moving member disposed in the pumping chamber, the moving member being configured to move ink through the pumping chamber;

a bearing having a first end operatively connected to the pumping chamber and a second end that terminates at a position above a floor of the ink reservoir, the bearing forming a channel between the pumping chamber and the second end of the bearing;

a flow restrictor that fluidly communicates with the inlet of the pumping chamber, the flow restrictor being configured to establish a positive pressure in the pumping chamber and urge ink through the space between the channel and the bearing in response to the moving member moving ink from the outlet of the pumping chamber through the pumping chamber to the inlet of the pumping chamber;

a first one-way valve that fluidly communicates with the inlet of the pumping chamber, the one-way valve configured to enable ink to flow from the pumping chamber through the inlet into the ink reservoir and to impede ink flow from the ink reservoir into the pumping chamber;

a drive shaft positioned in the channel of the bearing, the drive shaft being operatively connected to the moving member to move the moving member in the pumping chamber to move ink through the pumping chamber and to urge a portion of the ink in the pumping chamber into and through a space in the channel formed between the drive shaft and the bearing;

a bidirectional actuator that is operatively connected to the drive shaft; and;

a controller that is operatively connected to the bidirectional actuator, the controller being configured to operate the bidirectional actuator in a first direction to move the moving member and pump ink from the inlet of the pumping chamber through the pumping chamber to the outlet of the pumping chamber and in a second direction to move the moving member and pump ink from the outlet of the pumping chamber through the pumping chamber to the inlet of the pumping chamber.

15. The system of claim 14, the moving member comprising:

a first gear having teeth that is positioned in the pumping chamber;

the drive shaft being operatively connected to a motor for rotation of the shaft; and the pump further comprising:

a second gear positioned within the pumping chamber, the second gear having teeth that intermesh with the teeth on the first gear to enable the second gear to be rotated by the first gear in response to the drive shaft being rotated by the motor.

16. The system of claim 14 further comprising:

a flow restrictor placed in fluid communication with the outlet of the pumping chamber, the flow restrictor being configured to establish a positive pressure in the pumping chamber in response to the moving member moving ink from the inlet of the pumping chamber to the outlet of the pumping chamber.

17. The system of claim 14 further comprising:

a fluid bypass channel having a first end that is in fluid communication with the ink reservoir and a second end that is in fluid communication with the outlet of the pumping chamber, the fluid bypass channel having a second one-way valve configured to enable ink to flow through the bypass channel from the reservoir to the outlet of the pumping chamber in response to the moving member moving ink from the outlet of the pumping chamber to the inlet of the pumping chamber and to impede ink flow from the outlet of the pumping chamber to the reservoir in response to the moving member moving ink from the inlet of the pumping chamber to the outlet of the pumping chamber.

18. The system of claim 14 wherein a volume of the ink that moves through the channel is less than about five percent of a volume of ink moved by the moving member through the pumping chamber.

19. The system of claim 14 wherein the drive shaft is a reciprocating member that reciprocates the moving member within the pumping chamber.

20. The system of claim 14 further comprising:

a filter positioned in the reservoir at a position that filters ink returning to the reservoir through the space between the drive shaft and the bearing before the ink returns to the pumping chamber.

* * * * *